United States Patent [19]

Thibodeaux

[11] 4,379,493

[45] Apr. 12, 1983

[54] METHOD AND APPARATUS FOR PREVENTING WIRELINE KINKING IN A DIRECTIONAL DRILLING SYSTEM

[76] Inventor: Gene Thibodeaux, 7036 Linden Cir., Anchorage, Ak. 99502

[21] Appl. No.: 266,387

[22] Filed: May 22, 1981

[51] Int. Cl.[3] ..... E21B 7/04; E21B 7/12; E21B 47/024; E21B 47/12

[52] U.S. Cl. ..... 175/61; 175/45; 175/320

[58] Field of Search ..... 175/92, 104, 61, 50, 175/45, 40, 107, 320; 166/65 R, 178; 340/853, 856

[56] References Cited

U.S. PATENT DOCUMENTS

| | | | |
|---|---|---|---|
| 3,466,597 | 10/1967 | Richter, Jr. et al. . | |
| 3,696,332 | 10/1972 | Dickson et al. . | |
| 3,807,502 | 4/1974 | Heilhecker et al. . | |
| 3,825,078 | 7/1974 | Heilhecker et al. . | |
| 3,888,319 | 6/1975 | Bourne, Jr. et al. | 175/61 X |
| 3,918,537 | 11/1975 | Heilhecker . | |
| 4,098,342 | 7/1978 | Robinson et al. . | |
| 4,130,169 | 12/1978 | Denison . | |
| 4,143,721 | 3/1979 | Zuvela et al. | 175/61 X |
| 4,168,747 | 9/1979 | Youmans . | |
| 4,196,781 | 4/1980 | Cheek | 175/45 X |
| 4,200,297 | 4/1980 | Tricon . | |
| 4,220,381 | 9/1980 | van der Graaf . | |
| 4,325,438 | 4/1982 | Zuvela | 175/320 X |

*Primary Examiner*—Stephen J. Novosad
*Attorney, Agent, or Firm*—Bradford E. Kile

[57] ABSTRACT

A wireline protection sub (70) for a directional drilling system having a bit (92) and downhole motor (90), a bent angle sub (84), a jar (74) and a wireline directional tool (94) mounted within the drill string between the jar and the bit with a conductive wireline (96) extending from the directional tool to a surface location, wherein the wireline protection sub comprises a landing member (110) having a longitudinal passage and a stop member (130) operable to connect to the wireline (96) and engage the landing member (110) to support the wireline within the directional drilling string above the jar (74) to minimize coiling of the wireline adjacent the jar and reduce the tendency of the jar to kink or break the wireline during dynamic action of the jar.

45 Claims, 9 Drawing Figures

FIG. 2
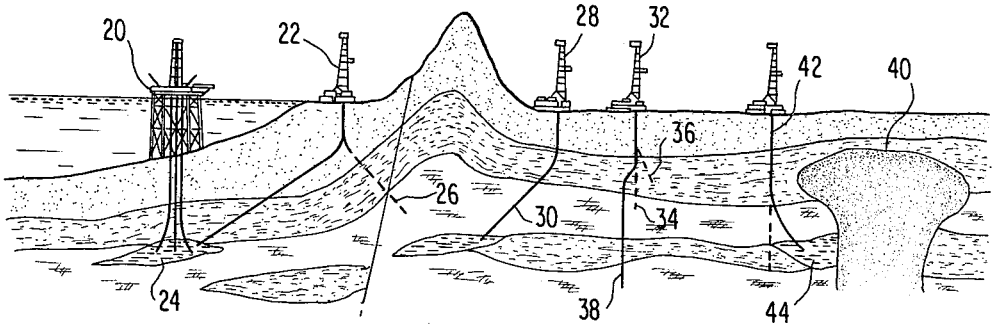
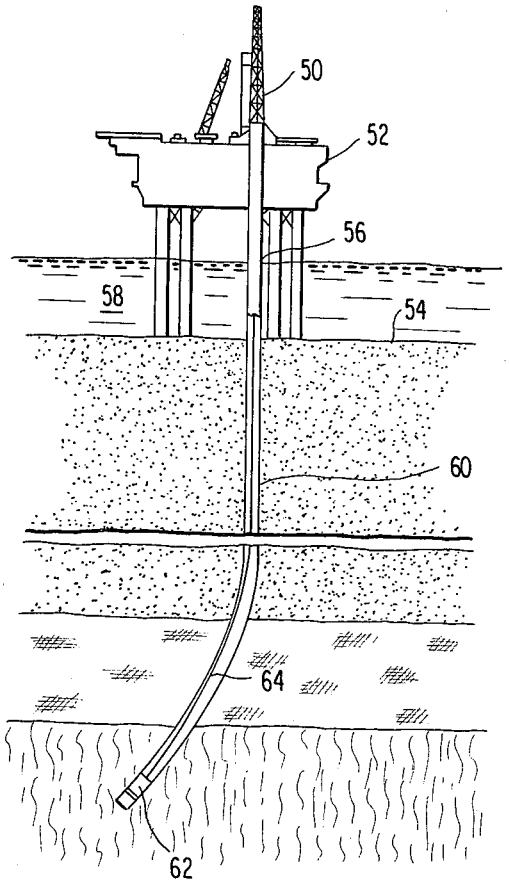
FIG. 3

FIG.6
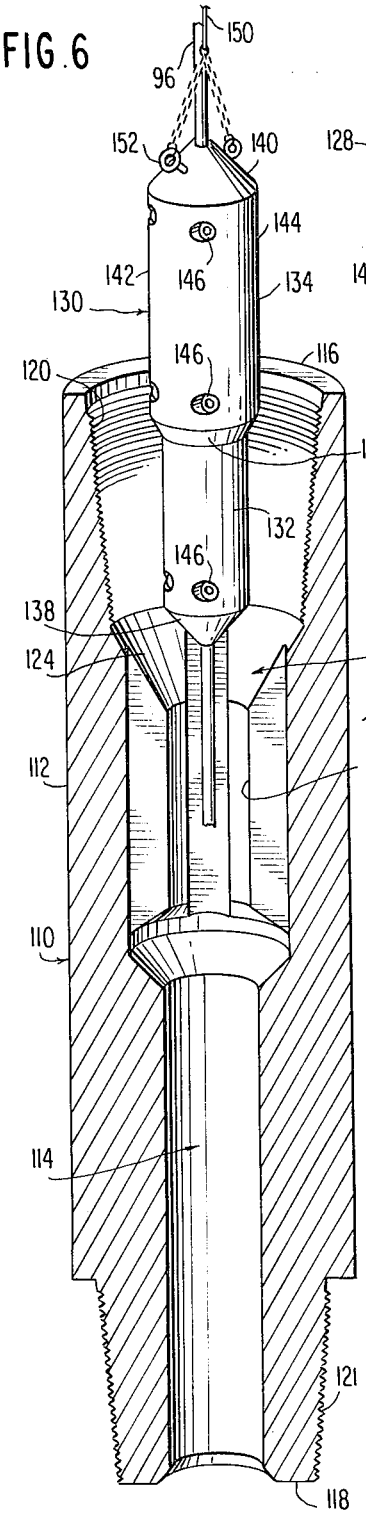
FIG.8
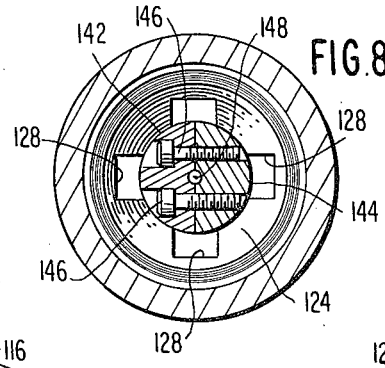
FIG.7
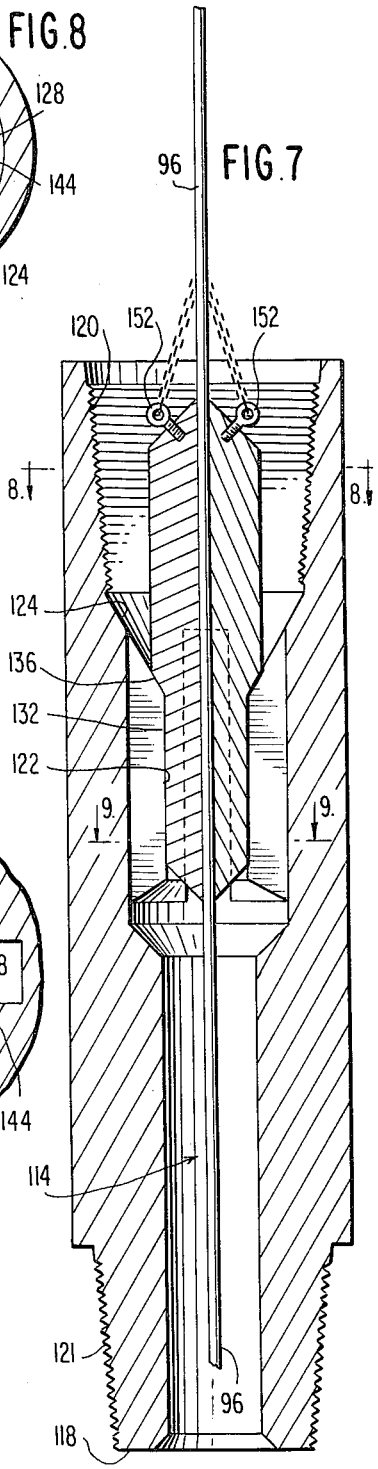
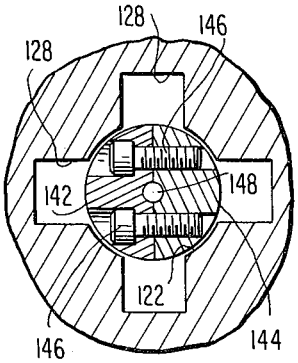
FIG.9

METHOD AND APPARATUS FOR PREVENTING WIRELINE KINKING IN A DIRECTIONAL DRILLING SYSTEM

BACKGROUND

This invention relates to directional drilling systems. More specifically this invention relates to an improved method and apparatus for protecting a wireline in a directional drilling system.

In the history of drilling within the earth in search of natural resources, such as oil and/or gas, situations have arisen where it has been either necessary or desirable to drill at an angle with respect to an imaginary vertical reference extending downwardly from the rotary table of a rig.

In the above connection in drilling adjacent a salt dome it is often desirable to drill along a lateral side of the dome and then deviate beneath the dome into a production zone. In other instances a well may collapse or become plugged and it becomes necessary to drill around or sidetrack the disruption. Further, rotary drilling equipment tends to drift or curve to the right due to the clockwise rotation of the drill string. This drift often requires straightening in order to penetrate a target zone. Still further production zones can be located in relatively inaccessible locations such as beneath rivers, swamps, cities, mountains, etc. Along near shore regions it is sometimes desirable to rig up on shore and deviate the drill string outwardly to an offshore location. At locations remote from a shore line towers or platforms may be erected upon a water bed where limitations on platform mobility and collection and production considerations dictate drilling multiple wells from a single station. Still further semi-submersible and drillship activity in relatively deep waters often requires directional drilling to explore laterally from a single submerged wellhead. For these and other reasons the concept of directional drilling has precipitated considerable interest and activity over the years.

The practice of controlled directional drilling of oil wells traces back at least to 1933 and the California Huntington Beach field. The principal tools initially developed for directional drilling were the whipstock, the knuckle joint and the spudding bit. Of these early tools the whipstock has probably been most widely utilized and is still a standard in the industry.

The whipstock is in principle a long, inverted wedge which is concave on one side and when run into the bottom of a drill hole can be used to deflect and guide a rotary drill string off into a deviated course as a new hole is drilled. Further in this connection the whipstock or wedge shaped unit may be releasably secured to a drill pipe and drill bit by a shear pin and then run into a well hole. On bottom the pin shears and the wedge is used to deflect the path of the drill bit.

Although whipstocks have received a considerable amount of commercial utilization the art of controlled directional drilling was significantly enhanced by the development of a directional drilling string which includes a bent angle sub, a downhole motor and bit and a wireline steering tool. (As used throughout this application the term "sub" refers to a drill pipe substitute which is inserted into a drill string for some special purpose while concomitantly permitting the drill string to function in its conventional drilling capacity.) Wireline directional drill strings have enabled a directional driller to continuously monitor inclination, azimuth and toolface orientation and take corrective actions without interrupting a drilling operation.

In addition to the above identified elements or operative segments, most drill strings, and directional drill strings in particular, employ a jar within the string. A jar is used in drill strings to minimize the possibility of the string becoming irretrievably stuck in a well hole. Numerous situations, individually and/or in combination, can cause a drill string to stick such as improper drilling fluid viscosity, formation tackiness, well hole deviations, etc. The tendency for sticking is particularly relevant in wireline directional drilling operations where the drill string, per se, is not rotated on a deviation run. Additionally the drill string exhibits a considerable force normal to the walls of a sloping well bore. Further drilling activity is often interrupted in deviation runs thus the drill string occasionally lies idle in the well hole. In light of the above a jar is considered by many directional drillers to be critically necessary in a wireline directional drill string.

While there are numerous designs for drilling jars most units include a hammer element and an anvil interconnected by some trip or releasable mechanism. In operation a generally predetermined lift or weight is placed on the drill string. This force causes the trip to release and the hammer strikes the anvil with an accelerating blow sufficiently violent to shake or jar the entire drill string. The operative stroke of a jar is provided by a telescoping spline element and typically the stroke of a jar will be twenty two or so inches in length.

In a wireline directional drilling string the wireline extends from the steering tool upwardly through the interior of the jar and onto the surface. The wireline is composed of an electrical conductor surrounded by an insulator and a protective wire braided sheath for strength. At the surface, data from the steering tool is continuously processed as the new hole advances as indicated above.

Although wireline directional systems are highly advantageous a significant problem exists for directional drillers using wireline systems of the type previously described. In this regard although the jar is set to "go off" at a predetermined amount of push or pull the exact timing is not accurately predictable. Moreover the acceleration of the hammer into the anvil, which is necessary to produce an effective shake or jar to the string, has a tendency to kink or even in some instances snap the wireline. When kinking occurs, communication with the steering tool tends to become intermittent to non-existent. In such event directional drilling must be shut down and the steering tool must be pulled and rewired before the directional run can proceed. Of course any down time on a rig is quite expensive and can quickly mount up to several thousand dollars.

The foregoing problem of kinking and re-running wireline has become so critical that in some instances directional drillers have gambled on the drill string not becoming struck and running the directional string without utilizing a jar. Of course if the string does become struck significant downtime is inevitable as a sidetracking run is made.

OBJECTS OF THE INVENTION

It is therefore a general object of the invention to provide a novel, wireline protection sub method and apparatus which will obviate or minimize difficulties of the type previously described.

It is a specific object of the invention to provide a wireline protection method and apparatus for a directional drilling string wherein the tendency of a jar within the directional drill string to kink or break the wireline will be minimized.

It is a related object of the invention to provide a wireline protection method and apparatus wherein coiling of an electrical wireline above, around and/or within a jar in a directional drill string will be minimized.

It is another object of the invention to provide a wireline protection method and apparatus for a directional drill string wherein the wireline is operably centered with the drill string in a posture adjacent a jar in the drill string.

It is a further object of the invention to provide a wireline protection method and apparatus for a directional drill string wherein a continuous flow of drilling fluid within the drill string will not be interrupted.

It is a further object of the invention to provide a wireline protection method and apparatus for a directional drill string which is not intricate but rather highly rugged in design and suitable for use in the hostile environment of a directional drilling system.

BRIEF SUMMARY OF A PREFERRED EMBODIMENT OF THE INVENTION

A preferred embodiment of the invention which is intended to accomplish at least some of the foregoing objects comprises a wireline protection sub for a directional drilling system having a bit and downhole motor, a bent angle sub, a jar and a wireline directional tool mounted within the drill string between the jar and the bit with a conductive wireline extending from the directional tool to a surface location. The wireline protection sub comprises a landing member having a longitudinal passage and a stop member operable to connect to the wireline and engage the landing member to support the wireline within the directional drilling string above the jar. The protection sub minimizes coiling of the wireline adjacent the jar and reduces the tendency of the jar to kink or break the wireline during dynamic action of the jar.

A method in accordance with the invention to minimize the tendency of a jar to kink a wireline includes the steps of connecting a stop member to the wireline axially spaced along the wireline at a distance greater than the axial distance between the operative position of a directional tool and the jar. The method further comprises the steps of running the directional tool on the wireline down the drill string, engaging the directional tool within the drill string adjacent a bent angle sub, and supporting the wireline from a further stop means within the landing sub such that coiling of the wireline above the jar and kinking of the wireline will be minimized upon dynamic action of the jar.

THE DRAWINGS

Other objects and advantages of the present invention will become apparent from the following detailed description of a preferred embodiment thereof taken in conjunction with the accompanying drawings, wherein:

FIG. 2 is a elevational schematic view of a plurality of illustrative situations where deviated drilling techniques have been utilized;

FIG. 3 is an elevational schematic view of an offshore drilling operation wherein a wireline directional drilling tool is illustratively shown within a drill string;

FIG. 6 is a side, partially sectioned, elevational view of the wireline protection sub wherein a stop member is shown clamped to a wireline and being suspended in a posture just prior to engagement with a landing member for supporting the wireline;

FIG. 7 is a cross-sectional view of the wireline protection sub wherein the stop member is seated within the landing member to support the wireline while permitting drilling fluid to pass through the protection sub via bypass passages;

Figure 1:
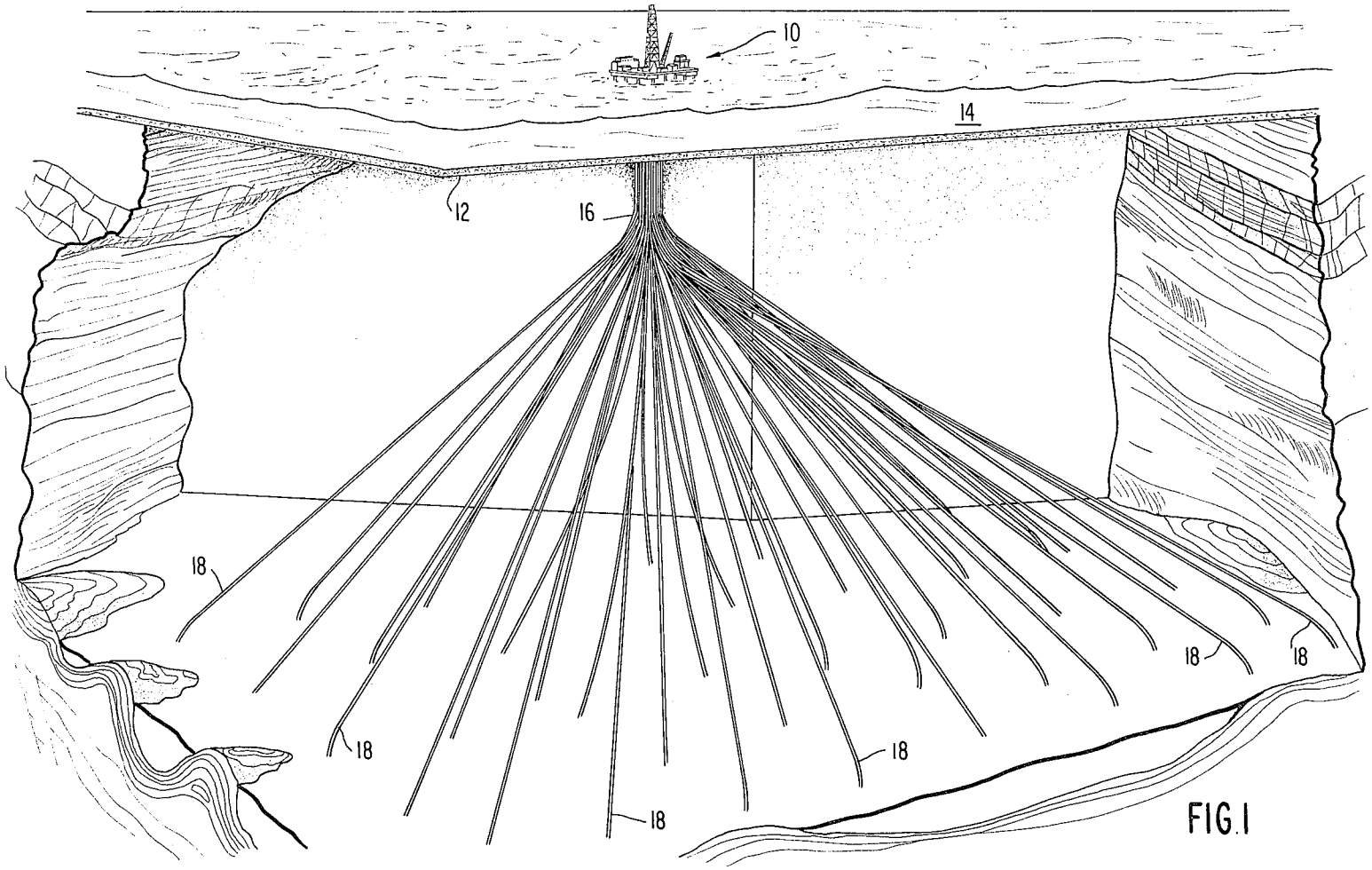
FIG. 1 is a broken away axonometric view of an offshore drilling operation wherein a plurality of well holes are shown originating from a single platform station and being deviated to a wide array of terminal locations.

FIG. 8 is a cross-sectional view taken along section line 8—8 in FIG. 7 and discloses the diametrical extent and location of the bypass passages; and FIG. 9 is a cross-sectional view taken along section line 9—9 in FIG. 7, which has been enlarged slightly in scale with respect to FIG. 7, and discloses a first portion of the stop member received within an axial passage of the landing member with surrounding bypass channels to permit drilling fluid to pass through the wireline protection sub.

DETAILED DESCRIPTION

Referring now to the drawings there will be seen various views of a wireline protection sub in accordance with a preferred embodiment of the invention.

Context of the Invention

Before describing the structural detail of a presently preferred embodiment of the subject wireline protection sub it may be worthwhile to briefly outline the operating context of the invention. In this connection FIG. 1 discloses a illustrative offshore platform 10 positioned upon the bed 12 of a body of water 14. Currently similar offshore structures are working extensively on the near shore and shelf regions of the world such as in the Gulf of Mexico, North Sea, Cook Inlet, Gulf of Campeche, etc.

The platform 10 is typically pinned to the seabed by pilings or constructed with a heavy gravity base. Accordingly it is difficult and/or time consuming to change the location of a platform once on station. Accordingly a plurality of wells are typically drilled from each platform. In order to drill into target zones which are laterally displaced from the platform the drill strings are deviated during the drilling process. Note the general points of deviation 16 of the plurality of wells depicted in FIG. 1. With current directional drilling techniques it is feasible to drill 50 or more wells from a single platform and laterally deviate any given well thousands of feet outwardly from the platform station. For purposes of illustration note the outer well hole 18 in FIG. 1. Moreover the capability of deviating a plurality of wells from a single platform simplifies gathering systems and production techniques which is a significant factor in the economic feasibility of the offshore oil and gas industry.

FIG. 2 schematically illustrates in addition to offshore platform work 20, other instances where directional drilling techniques are either necessary or desirable. In this regard it is possible to utilize a land based rig 22 and deviate a well into an offshore target formation as at 24. Another application is in fault control. If the well bore is parallel to a fault a directional well can be used to minimize the hazard of drilling a vertical well through a steeply inclined fault plane which could slip and shear the casing, note well 26.

In addition to the above, in some instances a producting zone may be located beneath an inaccessible location such as a river, swamp, city, mountain, etc. In such event a remote rig 28 may be installed and a deviated drilling technique may be advantageously utilized to guide a drill string 30 into an otherwise inaccessible production formation. Rig 32 depicts remedial drilling activity where a drill string is deviated to sidetrack an obstruction as at 34 or bring a crooked hole 36, back to vertical as at 38. In still another instance directional drilling techniques are often used in salt dome drilling. If a production formation is situated beneath the cap of a salt dome 40, a vertical well 42 may be started adjacent the salt dome and deviated into a production formation 44. For the above and other related reasons directional drilling is extensively utilized throughout the industry.

As previously indicated early directional drilling was accomplished by a whipstock method. More recently the trend in directional drilling has been toward use of a downhole motor to drive a drill bit downstream of a bent sub. A steering or directional tool is typically mounted adjacent the bent sub and is connected to the surface via an electrical wireline so that inclination, azimuth and toolface orientation can be monitored simultaneously with a new hole formation.

In the above connection FIG. 3 schematically represents a conventional wireline directional drilling run. More specifically a rig 50 is supported upon an offshore platform pinned to a waterbed 54. A riser 56 extends through the body of water 58 and surrounds a drill string used to form a drill hole 60. When a deviation run is indicated the conventional rotary drill string is pulled and a downhole motor and bit combination with a bent angle sub and steering tool 62 is run into the bore hole. An electrical wireline 64 extends from the steering tool up to the surface within the interior of the directional drill string. After a directional run of one to two hundred feet or so is completed the direction string is pulled and the conventional rotary string re-inserted for continued drilling. In operation several directional runs may be required for each well.

Figure 4:
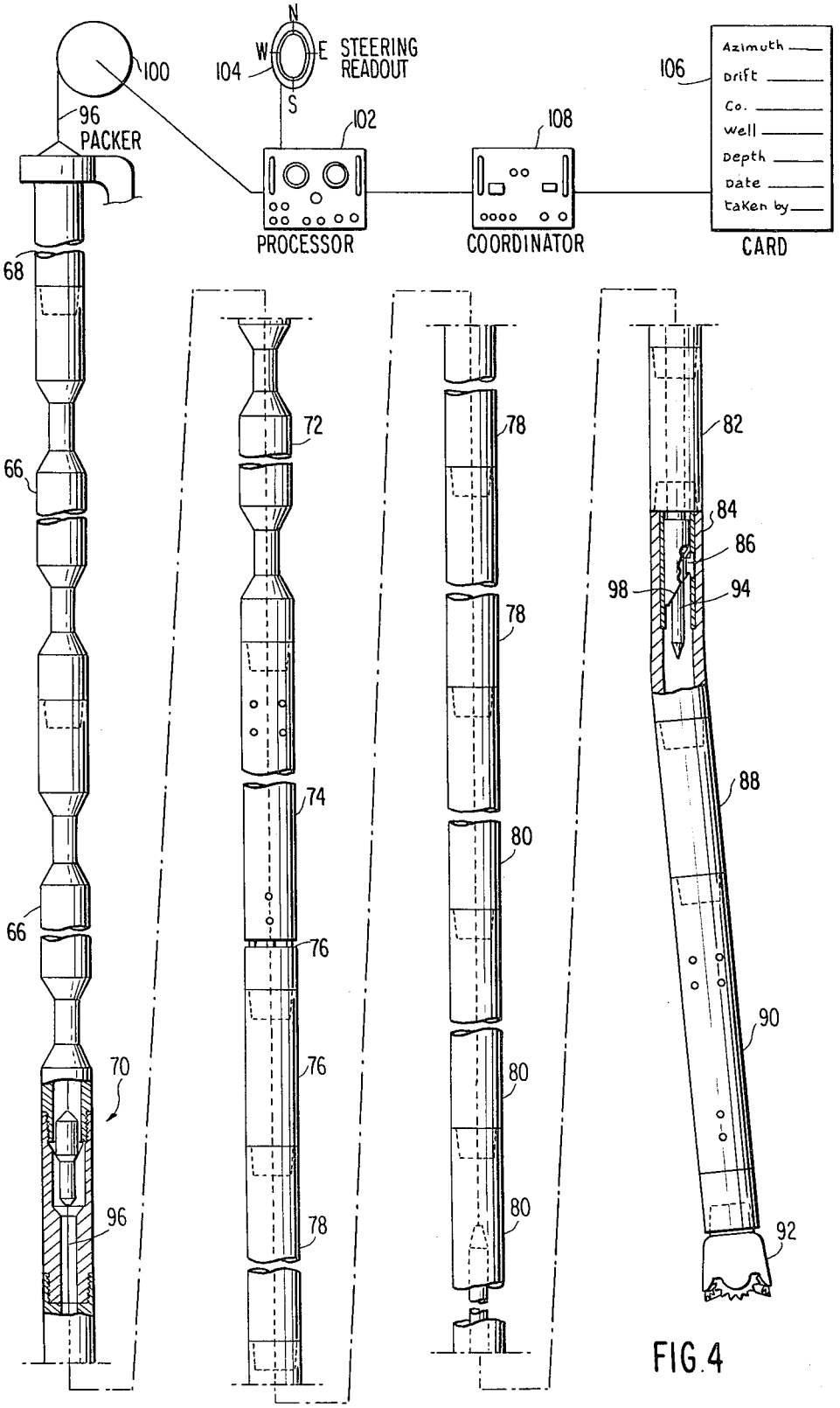
FIG. 4 is a more detailed view of a directional drilling system including a drilling bit and downhole rotary motor, a bent angle sub, a jar, a wireline directional tool mounted within the drill string adjacent the bent angle sub and a wireline protection sub.
Figure 5:
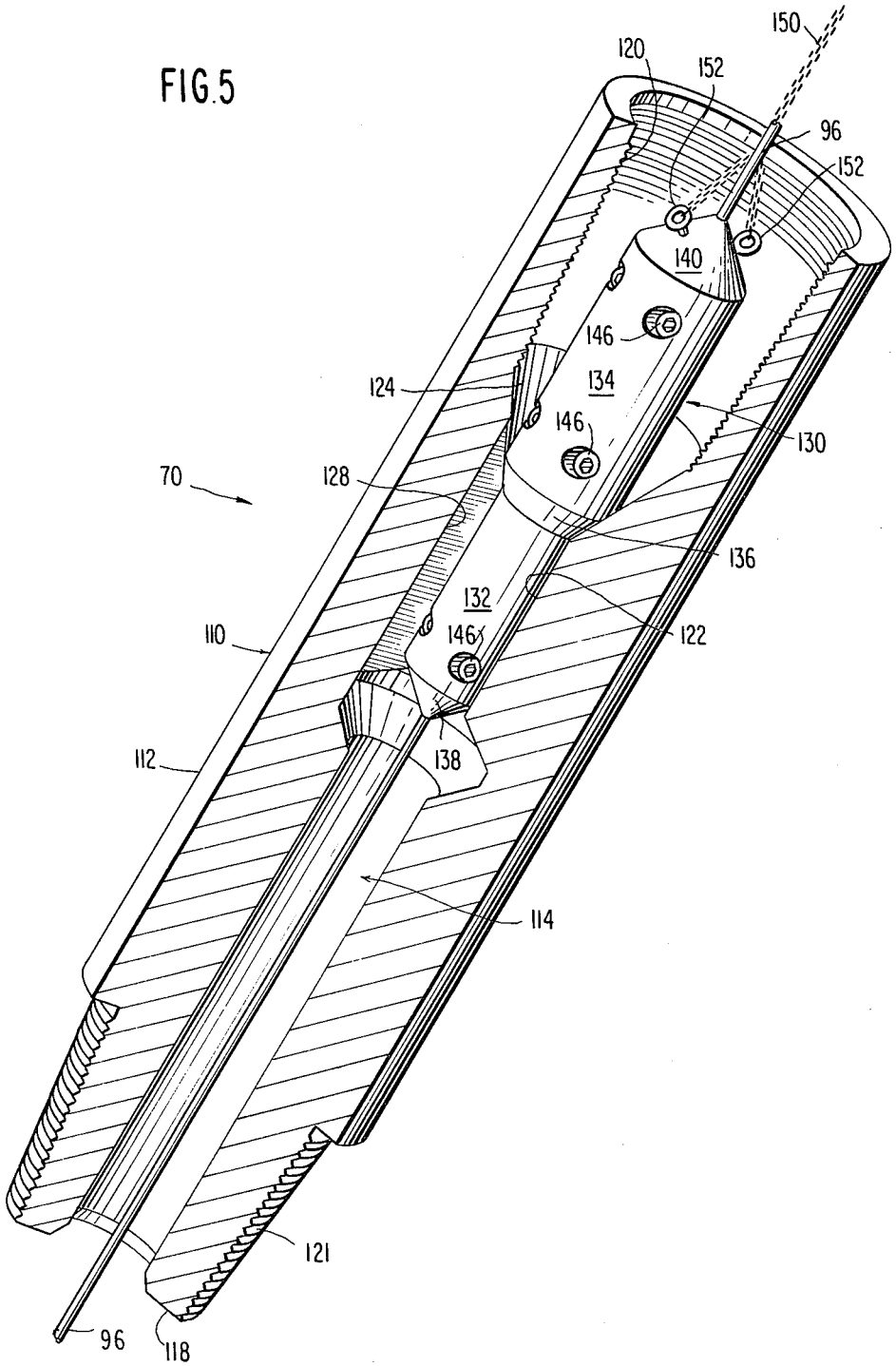
FIG. 5 is an axonometric detail view of a wireline protection sub in accordance with a preferred embodiment of the invention wherein a 120° section is made in the side of a landing member to disclose internal detail.

Turning now to FIG. 4 there will be seen in greater detail a directional drilling system forming the specific operative environment of the subject invention. The downhole elements of the system comprise a plurality of heavy weight drill pipe segments 66 extending from a rotary table through a previously drilled well hole and connect onto a wireline protection sub 70 in accordance with a presently preferred embodiment of the invention. The broken line at 68 may represent a string of drill pipe extending thousands of feet with the earth.

Downstream of the protection sub 70 is another heavy walled drillpipe 72 which mounts onto a jar 74. The jar 74 is connected via a cross-over sub 76 to several lengths of steel drill collars 78 and monel drill collars 80. Another cross-over sub 82 connects the monel drill collars 80 to a bent angle sub 84 carrying a mule shoe key 86. A float sub 88 is mounted downstream of the bent angle sub and connects to a downhole motor 90 which serves to rotate a bit 92.

Before discussing the top side elements of the directional drilling system a few of the major components of the downhole system warrant further attention. As previously indicated the jar 74 is incorporated into the drill string to shake or jar the drill string to prevent sticking of the string within the well hole. Several types of jars are commercially available in the industry. In this connection Johnson/Schumberger of Houston, Tex. 77036, Sii Division of Smith International, Inc., Gardena, Calif., 90248 and Eastman-Whipstock Dailey Oil Tools Inc., Houston, Tex. 77020 each advertise commercially available jars at pages 4211–4214, 6477 and 2092–2093 respectively of the Composite Catalog of Oil Field Equipment and Services 1980–81 published by World Oil, P.O. Box 2608, Houston, Tex. 77001, U.S.A. The disclosure of these illustrative jars are hereby incorporated by reference as though set forth at length.

The bent angle sub 84 is a tool joint machined to an exact offset angle. As indicated in FIG. 4 this offset angle creates a bend which imparts a lateral force to an advancing drill bit. Since the bent sub does not rotate the lateral force can be positioned in a predetermined direction and in operation the bend creates a smooth continuing arc of curvature in a drilled hole. Although angles can vary, usually a bent angle sub is offset about 1 to 2 degrees.

As previously indicated the drill bit 92 is rotated by a downhole motor 90. One embodiment of a downhole motor or turbodrill uses fluid that is pumped under pressure through central void areas of the unit between a rotor and a rubber-lined spiral passageway of an outer stator. In order for the flow of drilling fluid to occur, the rotor is displaced and turned within the stator by the pressure of the fluid column, thus powering the connecting rod, a hollow drive shaft and finally a conventional bit sub at the end of the tool. Another embodiment of a downhole motor includes turbine and stator blades mounted upon turbine wheels and the tool housing respectively and in the flow path of drilling fluid through the motor. For a more detailed disclosure of turbo-motors reference may be had to the advertisements of commercially available units from Sii Dyna-Drill Division of Smith International, Inc., Irvine, Calif., 92713 and Eastman Whipstock, Inc., Houston, Tex., 77021 as featured at pages 2545 and 2572–2573 respectively of the Composite Catalogue 1980–81 published by World Oil as previously indicated. The disclosures of these publications are incorporated by reference also.

Finally a downhole directional system includes a directional or steering tool 94 which is run down a drill string on a wireline 96 from a drilling platform. The steering tool is provided with a dual 180 degree ramp 98 which terminates in a slot dimensioned to slip over the mule shoe 86. Accordingly the steering tool is oriented with respect to the bent angle sub as it seats on the mule shoe. In operation the steering tool measures well hole inclination, direction (azimuth) and toolface orientation. This information is transmitted to the surface on a continuous real time basis by a wireline 96 comprising a shielded electrical conductor surrounded with a metallic braid. Steering tools are also available on a commercial basis in the industry. Examples of suitable directional tools are those available through Scientific Drilling Controls, Irvine, Calif. 92714, Sperry-Sun International, Inc., Houston, Tex. 77036 and Eastman Whipstock, Inc. Houston, Tex. 77021 and disclosed at pages 6417–6418, 6632–6637 and 2563 respectively of the Composite Catalog 1980–81. The disclosures of these steering tools are incorporated by reference as though set forth at length.

The wireline 96 extends up the drillstring and emerges through a conventional packing member and onto a tensioning drum 100 of a wireline unit operable to take up and pay out the wireline as needed. Information from the steering tool is input into a processor 102 which is programmed to calculate hole drift and azimuth angle. Steering readout may be visually monitored on a remote unit 104. In order to maintain a permanent record a card 106 may be inserted into a coordinator 108 which is operable to imprint azimuth, drift and other relevant data on the card as indicated in FIG. 4.

The top side processing equipment is also commercially available from the previously indicated sources of directional tools such as Scientific Drilling, Sperry-Sun or Eastman Whipstock.

Wireline Protection Sub

Having outlined the operative context and environment of the subject invention the readers attention is now invited to FIGS. 5–9 where various detail views of the wireline protection sub 70 is shown in accordance with a presently preferred embodiment of the invention.

As previously indicated the industry has been burdened in the past with kinking and in some instances snapping of the steering tool wireline when the jar goes off. Such kinking disrupts electrical communication requiring the steering tool 94 to be pulled up, rewired and replaced before directional drilling can continue. The time consuming nature of this operation and the high probability of kink occurring in the wireline when the jar goes off has induced some directional drillers to gamble on the drill string not becoming stuck and thus leaving the jar out of the system.

A better solution to wireline kinking is provided by the subject wireline protection sub 70. The sub includes a landing member 110 having a cylindrical outer wall surface 112 and a longitudinal passage 114 extending from one end 116 of the landing sub to the other 118. The one end of the landing sub 116 is internally threaded, as at 120, to receive a connecting portion of a length of heavy walled drill pipe as shown in FIG. 4. The other end of the landing member is formed with an external thread 121 so that the landing member can be turned into a downstream length of heavy walled drill pipe.

The longitudinal passage 114 includes an axial bore 122 and a seat portion 124 having an internal surface in the form of a truncated cone with the small end opening directly into the axial bore 122. A plurality of longitudinal bypass passages, channel or grooves 128 extend within the internal portion of the landing sub side wall in a position radially outwardly with respect to the axial passage or bore 122. The cross-sectional configuration of the channels 128 are shown as being generally rectangular. Other configurations are also contemplated, however, such as semi-circular or circular wherein the channels do not open into the axial bore but rather run within the side wall substantially parallel with the axial bore but radially offset and separate therefrom.

The wireline protection sub 70 further includes a stop member 130. The stop member 130 is generally cylindrical in configuration and includes a first cylindrical portion 132 which is dimensioned to the slidingly received within the axial bore 122 of the landing member, note FIGS. 5 and 7. The stop member 130 includes a second cylindrical portion 134 which has a diameter greater than the diameter of the first portion 132. The transition from the first cylindrical portion 132 to the second cylindrical portion 134 is formed into a truncated conical surface 136 having a side wall slope operable to cooperatively seat with the slope of the landing member seat 124, note FIG. 7.

The stop member 130 is formed with a conical end portion 138 on the first cylindrical portion 132 which advantageously serves to guide the stop member through the drill pipe and into the axial passage 122 as the directional tool is run down the drill string. In a similar manner the second cylindrical member 134 terminates with a conical portion 140 which facilitates withdrawal of the stop member from the drill string.

The stop member 130 is formed from two opposing halves 142 and 144 lying upon opposite sides of an imaginary plane extending through a central longitudinal axis of the stop member. The two halves are releasably secured together by a plurality of machine bolts 146. An axial passage 148 extends through the stop member and is dimensioned to receive the wireline 96 as previously described. The diametrical dimension of the axial passage 148 through the stop member is slightly less than that of the wireline. Accordingly as the machine bolts 146 draw the two halves 142 and 144 of the stop member together the wireline 96 is securely engaged by frictional contact within the stop element 130.

In a preferred embodiment a safety line 150 is releasably connected via eye bolts 152 to the upper end 140 of the stop member 130. This line operably runs parallel with the wire rope 96 and is operable to facilitate secure control and retrieval of the stop means from the landing member 110.

In operation, when a deviation run is indicated, the conventional rotary drill string is pulled and a directional drilling string as shown in FIG. 4 is made up and run into the well hole. Prior to run in the distance from the mule shoe 86 to the seat 124 of the wireline protection sub 70 is determined. The stop member 130 is mounted about the wireline 96 at a distance above the steering tool slot equal to the distance from the mule shoe 86 to the member seat 124 plus the operative stroke of the jar 74 and a small degree of play such as a few inches.

The steering tool 94 is then run into position and the wireline 96 is supported above the jar but adjacent thereto by the wireline protection sub 70. This wireline support adjacent the jar generally centers the wireline above the jar and minimizes any tendency of the wireline to coil around, within and above the jar. Accordingly when the jar goes off the tendency of the jar to kink the wireline is minimized.

SUMMARY OF MAJOR ADVANTAGES OF THE INVENTION

After reading and understanding the foregong description of the invention, in conjunction with the drawings, it will be appreciated that several distinct advantages of the subject wireline protection sub are obtained.

Without attempting to set forth all of the desirable features of the instant invention at least some of the major advantages include the unique combination of a landing member and a wireline stop member operably positioned within a directional drilling string adjacent to but spaced above a jar to minimize coiling of the wireline adjacent the jar and kinking of or snapping of the wireline when the jar goes off.

The subject landing member operably funnels the stop member concentrically into position to support and center the wireline above the jar. The peripheral bypass channels or grooves through the side wall of the landing member permits drilling fluid to bypass the stop member and thus normal directional drilling will not be disrupted.

The stop member is formed in halves and is releasably secured about the wireline to provide axial adjustability along the wireline but secure clamping of the wireline is a desired position.

The first cylindrical element of the stop member operably slides into the axial bore of the landing member to vertically orient the stop member element within the landing member and the conical seat insures automatic centering of the wireline within the sub as the wireline is run-in with the steering tool.

The conical end members facilitate running-in and withdrawal of the wireline and seating of the stop member securely and fully within the landing member. The safety line provides a secure attachment and control of the stop member from the surface in addition to the wireline.

In describing the invention, reference has been made to a preferred embodiment and illustrative advantages of the invention. Those skilled in the art, however, and familiar with the instant disclosure of the subject invention, may recognize additions, deletions, modification, substitutions and/or other changes which will fall within the purview of the subject invention and claims.

I claim:

1. In a wireline directional drilling system including a drill string having a bit and downhole motor for rotating the bit, a bent angle sub and a jar and a wireline directional tool mounted within the drill string adjacent the bent angle sub with a wireline extending from the directional tool upward to a surface location wherein the improvement comprises:

a landing sub coaxially mounted within the drill string above the jar and having at least one longitudinal passage therethrough for permitting drilling fluid to pass within the drill string, through said landing sub and through the downhole motor and bit; and stop means connected to the wireline for engaging said landing sub and supporting the wireline between said landing sub and the directional tool while concomitantly permitting drilling fluid to pass through said landing sub, said stop means being connected to the wireline in a position to permit a degree of slack in the wireline between the landing sub and the directional tool in excess of the maximum stroke of the jar but with sufficient tautness in the wireline between said landing sub and the directional tool to minimize coiling of the wireline adjacent the jar and reduce the tendency of the jar to kink the wireline during dynamic action thereof.

2. In a wireline directional drilling system as defined in claim 1 wherein:

said landing sub includes a seat portion; and said stop means includes a seat portion configured and dimensioned to cooperate with the seat portion of said landing sub wherein the stop means operably rests upon said seat portion of said landing sub to suspend the wireline between said landing sub and the directional tool.

3. In a wireline directional drilling system as defined in claim 2 wherein:

said at least one longitudinal passage of said landing sub includes an axial passage extending end to end of said landing sub;

said seat portion of said landing sub comprises a truncated conical wall segment sloping inwardly and downwardly within said landing sub toward said axial passage; and said stop means seat portion comprises a conical walled segment dimensioned to engage the conical seat of said landing sub wherein said stop means and wireline are operably centered within said landing sub.

4. In a wireline directional drilling system as defined in claim 3 wherein:

said at least one longitudinal passage in said landing sub further includes a plurality of longitudinal bypass passages extending within a side wall of said landing sub radially outwardly from said axial passage of said landing sub.

5. In a wireline directional drilling system as defined in claim 4 wherein:

each of said longitudinal bypass passages is open along the inward lateral extent thereof and in fluid communication with said axial passage of said landing sub.

6. In a wireline directional drilling system as defined in claim 3 wherein:

said stop means comprises a generally cylindrical member coaxially mounted about the wireline and said stop means seat portion comprises a radially outwardly extending shoulder.

7. In a wireline directional drilling system as defined in claim 3 wherein:

said stop means comprises a generally cylindrical member coaxially mounted about the wireline and having a first portion and a second portion wherein the radial dimension of the second portion and the transition between the first portion and the second portion comprises said conical seat portion of said stop means.

8. In a wireline directional drilling system as defined in claim 7 wherein:

said at least one longitudinal passage in said landing sub comprises a plurality of longitudinal bypass passages within a side wall of said landing sub and being radially outwardly extending with respect to said axial passage of said landing sub;

said first portion of said stop means being radially dimensioned to be coaxially received within said axial passage of said landing sub; and said second portion of said stop means being radially dimensioned to be greater than the radial dimension of said axial passage of said landing sub but less than the outer radial extent of said plurality of longitudinal bypass passages such that drilling fluid is free to pass around said stop means and through said landing sub notwithstanding operative positioning of said stop means within said landing sub to support said wireline.

9. In a wireline directional drilling system as defined in claim 8 wherein:

said cylindrical first portion of said stop means terminates in a conical configuration sloping inwardly and downwardly with the apex thereof surrounding the wireline such that said stop means may be faciley self guiding through the drill string and into said landing sub.

10. In a wireline directional drilling system as defined in claim 9 wherein:

said cylindrical second portion of said stop means terminates in a conical configuration sloping inwardly and upwardly with the apex thereof surrounding the wireline such that withdrawal of the stop means from the landing sub within the drill string will be facilitated.

11. In wireline directional drilling system as defined in claim 10 and further comprising:

line means releasably connected to said conical configuration of said second portion of said stop means and running generally parallel with the wireline to facilitate secure control and retrieval from the surface of said stop means from said landing sub.

12. In a wireline directional drilling system as defined in claim 7 wherein:

said generally cylindrical stop means being fashioned with an axial passage from end to end, said passage having a diameter less than the diameter of the wireline;

said cylindrical stop means further being longitudinally divided into opposing halves by an imaginary plane extending through a central longitudinal axis of said stop means; and means for releasably connecting said halves together such that the wireline may be positioned between the halves and within the axial passage of said generally cylindrical stop means and the stop means may be clamped about the wireline in secure frictional engagement by said means for releasably connecting.

13. In a wireline directional drilling system including a drill string having a bit and downhole motor for rotating the bit, a bent angle sub and a jar and a wireline directional tool mounted within the drill string between the jar and the bit with a wireline extending from the directional tool, upwardly through the drill string, to a surface location, wherein the improvement comprises:

a landing sub coaxially mounted within the drill string above the jar, said landing sub having a central longitudinal passage from end to end thereof, a plurality of longitudinal extending bypass passages positioned radially outwardly from said central longitudinal passage, and in fluid communication with said central longitudinal passage, and a seat fashioned within said landing sub about said central longitudinal passage; and generally cylindrical stop means connected to the wireline, said stop means having a seat portion configured and dimensioned to cooperate with said seat of said landing sub and having an exterior radial dimension less than the outermost radial extent of said bypass passages, said stop means being operable to engage said landing sub and support the wireline between said landing sub and the directional tool while concomitantly permitting drilling fluid to pass through said landing sub, said stop means being connected to the wireline at a position to permit a degree of slack in the wireline between said landing sub and the directional tool in excess of the maximum stroke of the jar but with sufficient tautness in the wireline between said landing sub and the directional tool to reduce the tendency of the jar to kink the wireline during dynamic action thereof.

14. In a wireline directional drilling system as defined in claim 13 wherein:

said plurality of longitudinally extending bypass passages comprise channels fashioned within a side wall of said landing sub radially outwardly from said central longitudinal passage.

15. In a wireline directional drilling system as defined in claim 14 wherein:

said central longitudinal passage being fashioned with a cylindrical configuration with a first diameter;

said seat witin said landing sub having a truncated cone configuration and extending from said central longitudinal member upward and outwardly; and said plurality of bypass channels extend through the conical surface of said landing sub seat and forming openings through said seat radially outwardly with respect to said first diameter of said central longitudinal passage.

16. In a wireline directional drilling system as defined in claim 15 wherein:

said stop means comprises a generally cylindrical member coaxially mounted about the wireline and having a first portion and a second portion wherein the diameter of the first portion is less than the diameter of said central longitudinal passage and the diameter of the second portion is greater than the diameter of said central longitudinal passage but less than the diametrical extent of said plurality of bypass channels and the transition zone between said first portion and said second portion comprises a conical seat portion of said stop means.

17. In a wireline directional drilling system as defined in claim 16 wherein:

said cylindrical first portion of said stop means terminates in a conical configuration sloping inwardly and downwardly with the apex thereof surrounding the wireline such that said stop means may be faciley self guided through the drill string and into said landing sub; and said cylindrical second portion of said stop means terminates in a conical configuration sloping inwardly and upwardly with the apex thereof surrounding the wireline such that withdrawal of the stop means from the landing sub through the drill string will be facilitated.

18. In a wireline directional drilling system as defined in claim 17 wherein:

said generally cylindrical stop means being fashioned with an axial passage from end to end, said passage having a diameter less than the diameter of the wireline;

said cylindrical stop means being longitudinally divided into opposing halves by an imaginary plane extending through a central longitudinal axis of said stop means; and means for releasably connecting said halves together such that the wireline may be positioned between the halves of said stop means and in alignment with said axial passage and the stop means may be clamped about the wireline in secure frictional engagement by said means for releasably connecting.

19. In a wireline directional drilling as defined in claim 18 and further comprising:

line means releasably connected to said conical configuration of said second portion of said stop means and running generally parallel with the wireline to facilitate secure control and retrieval from the surface of said stop means from said landing sub.

20. In a wireline directional driling system including a drill string having a bit and downhole motor for rotating the bit, a bent angle sub, a jar and a wireline directional tool mounted within the drill string between the jar and the bit with a wireline extending from the directional tool, to the surface, wherein the improvement comprises:

a landing sub coaxially mounted within the drill string above the jar and having at least one longitudinal passage therethrough for permitting drilling fluid to pass within the drill string, through said landing sub and through the downhole motor and bit;

stop means connected to the wireline for engaging said landing sub and supporting the wireline between said landing sub and the directional tool while concomitantly permitting drilling fluid to pass through said landing sub;

means within said landing sub for receiving said stop means; and means on said stop means for guiding said stop means into engagement with said means for receiving within said landing sub, said stop means being connected to the wireline in a position to permit a degree of slack in the wireline between the landing sub and the directional tool in excess of the maximum stroke of the jar but with sufficient tautness in the wireline between said landing sub and the directional tool to minimize coiling of the wireline adjacent the jar and reduce the tendency of the jar to kink the wireline during dynamic action thereof.

21. In a wireline directional drilling system as defined in claim 20 wherein:

said at least one longitudinal passage through said landing sub comprises an axial passage and at least one bypass passage positioned radially outwardly with respect to said axial passage.

22. In a wireline directional drilling system as defined in claim 21 wherein:

said at least one bypass passage comprises a plurality of bypass passages and being is lateral fluid communication with said axial passage.

23. In a wireline directional drilling system as defined in claim 22 wherein:

said plurality of bypass passages comprise longitudinal grooves formed into a side wall of said landing sub and extending outwardly from said axial passage.

24. In a wireline directional drilling system as defined in claim 23 wherein:

said stop means comprises a generally cylindrical member coaxially mounted about the wireline and having a first cylindrical portion operably to be received within said axial passage of said landing sub and a second enlarged cylindrical portion operable to engage said landing sub to support said wireline but being dimensioned to concomitantly permit drilling fluid to bypass said stop means through said bypass passages.

25. A wireline protection sub for a directional drilling system having a bit and downhole motor, a bent angle sub, a jar and a wireline directional tool mounted within the drill string between the jar and the bit with a wireline extending from the directional tool to a surface location, said wireline protection sub comprising:

a landing member operable to be mounted within the drill string above the jar and having at least one longitudinal passage therethrough for permitting drilling fluid to pass through the landing member and on to a downhole motor and bit in the directional drilling system; and a stop member being operable to be connected to the wireline for engaging said landing member and supporting the wireline between said landing member and the directional tool while concomitantly permitting drilling fluid to pass through said landing member, said stop member being operable to be connected to the wireline in a position to permit a degree of slack in the wireline between the landing sub and the directional tool in excess of the maximum stroke of the jar but with sufficient tautness in the wireline between said landing member and the directional tool to minimize coiling of the wireline adjacent the jar and reduce the tendency of the jar to kink the wireline during dynamic action thereof.

26. A wireline protection sub for a directional drilling system as defined in claim 25 wherein:

said landing member includes a seat portion; and said stop member includes a seat portion configured and dimensioned to cooperate with said seat portion of said landing member wherein the stop member operably rests upon said seat portion of said landing member to suspend a wireline between said landing member and the directional tool.

27. A wireline protection sub for a directional drilling system as defined in claim 26 wherein:

said at least on longitudinal passage of said landing member includes an axial passage extending end to end of said landing member;

said seat portion of said landing member comprises a truncated conical wall segment sloping inwardly and downwardly toward said axial passage; and said stop member seat portion comprises a conical wall segment dimensioned to engage the truncated conical seat of said landing member wherein said stop member and a wireline are operably centered within said wireline protection sub.

28. A wireline protection sub for a directional drilling system as defined in claim 27 wherein:

said at least one longitudinal passage in said landing member further includes a plurality of longitudinal bypass passages extending within a side wall of said landing member in a position radially outwardly with respect to said axial passage of said landing member.

29. A wireline protection sub for a directional drilling system as defined in claim 28 wherein:

said plurality of longitudinal bypass passages comprise longitudinal channels formed into the side wall of said landing member radially outwardly from said axial passage of said landing member.

30. A wireline protection sub for a directional drilling system as defined in claim 26:

said stop member comprises a generally cylindrical member coaxially mounted about the wireline and said stop member seat portion comprises a radially outwardly extending shoulder.

31. A wireline protection sub for a directional drilling system as defined in claim 26 wherein:

said stop means comprises a generally cylindrical member operable to be coaxially mounted about the wireline and having a first portion and a second portion wherein the diameter of the second portion is greater than the diameter of the first portion and the transition between the first portion and the second portion comprises a conical seat portion of said stop member.

32. A wireline protection sub for a directional drilling system as defined in claim 31 wherein:

said at least one longitudinal passage in said landing member comprises a plurality of longitudinal bypass passages within a side wall of said landing member and being radially outwardly extending with respect to said axial passage of said landing member;

said first portion of said stop member being radially dimensioned to be coaxially received within said axial passage of said landing member; and said second portion of said stop member being dimensioned to be greater in diameter than the diametrical dimension of said axial passage but less than the extent of said plurality of longitudinal bypass passages such that said conical seat portion of said stop member operably engages the seat portion of said landing member while drilling fluid is operably free to pass around said stop member and through said landing member.

33. A wireline protection sub for a directional drilling system as defined in claim 32 wherein:

said cylindrical first portion of said stop member terminates in a conical configuration sloping inwardly and downwardly with the apex thereof operable to surround a wireline such that said stop member may faciley pass through a drill string and into said landing member.

34. A wireline protection sub for a directional drilling system as defined in claim 33 wherein:

said cylindrical second portion of said stop member terminates in a conical configuration sloping inwardly and upwardly with the apex thereof operable to surround a wireline such that withdrawal of the stop member from the landing member through the drill string will be facilitated.

35. A wireline protection sub for a directional drilling system as defined in claim 34 and further comprising:

line means releasably connected to said conical configuration of said second portion of said stop member and being operable to run generally parallel with a wireline to facilitate secure control and retrieval at the surface of said stop member from said landing member.

36. In a wireline directional drilling system as defined in claim 32 wherein:

said generally cylindrical stop member being fashioned with an axial passage from end to end, said passage having a diameter less than the diameter of the wireline;

said cylindrical stop member being longitudinally divided into opposing halves by an imaginary plane extending through a central longitudinal axis of said stop member; and means for releasably connecting said halves together such that the wireline may be positioned between the halves and within the axial passage of said generally cylindrical stop member and the stop member may be clamped about the wireline in secure frictional engagement by said means for releasably connecting.

37. A wireline protection sub for a directional drilling system having a bit and downhole motor, a bent angle sub, a jar and a wireline directional tool mounted within the drill string between the jar and the bit with a wireline extending from the directional tool to a surface location, said wireline protection sub comprising:

a landing member operable to be coaxially mounted within a drill string above a jar and having at least one longitudinal passage therethrough for permitting drilling fluid to pass within the drill string, through said landing member and through a downhole motor and bit;

a stop member operable to be connected to the wireline for engaging said landing member and supporting the wireline between said landing member and the directional tool while concomitantly permitting drilling fluid to pass through said landing member;

means on said landing member for receiving said stop member; and means on said stop member for guiding said stop member into engagement with said means for receiving on said landing member, said stop member being operable to be connected to the wireline in a position to permit a degree of slack in the wireline between the landing member and the directional tool in excess of the maximum stroke of the jar but with sufficient tautness in the wireline between said landing member and the directional tool to minimize coiling of the wireline adjacent the jar and reduce the tendency of the jar to kink the wireline during dynamic action thereof.

38. A wireline protection sub for a directional drilling system as defined in claim 37 wherein:

said at least one longitudinal passage through said landing member comprises an axial passage and at least one bypass passage positioned radially outwardly with respect to said axial passage.

39. A wireline protecton sub for a directional drilling system as defined in claim 38 wherein:

said at least one bypass passage comprises a plurality of bypass passages each being in lateral fluid communication with said axial passage.

40. A wireline protection sub for a directional drilling system as defined in claim 39 wherein:

said plurality of bypass passages comprise longitudinal grooves formed into a side wall of said landing member outwardly from said axial passage.

41. A wireline protection sub for a directional drilling system as defined in claim 40 wherein:

said stop member comprises a generally cylindrical member operable to be coaxially mounted about the wireline and having a first cylindrical portion operable to be received within said axial passage of said landing member and a second enlarged portion operable to engage said landing member to support the wireline but being dimensioned to concomitantly permit drilling fluid to bypass said stop member through said bypass passages.

42. A method for minimizing the tendency to kink a wireline in a directional drilling system comprising a drill string having a bit and downhole motor for rotating the bit, a bent angle sub a jar and a wireline directional tool mounted within the drill string adjacent the bent sub wherein a wireline extends from the directional tool upward to a surface location and within the drill string at least to a position above the jar wherein the method comprises the steps of:

connecting a stop means to the wireline above the directional tool axially spaced along the wire line at a distance greater than the axial distance between the operative position of the directional tool and the jar; running the directional tool on the wireline down the drill string;

engaging the directional tool within the drill string adjacent the bent angle sub; and supporting the wireline from the stop means within a landing sub located within the drill string above the jar, wherein the stop means is further axially positioned upon the wireline so as to create a supporting tautness of the wireline between the directional tool and the landing sub while concomitantly providing a degree of slack between the landing sub and the directional tool slightly in excess of the maximum stroke of the jar such that coiling of the wireline above the jar and kinking of the wireline will be minimized upon dynamic action of the jar.

43. A method for minimizing the tendency to kink a wireline in a directional drilling system as defined in claim 42 wherein said step of connecting a stop means further comprises the steps of:

clamping a cylindrical member, having a central longitudinal passage and longitudinally divided in halves, about the wireline; and releasably connecting the two halves together with the wireline frictionally engaged within the central longitudinal passage.

44. A method for minimizing the tendency to kink a wireline in a directional drilling system as defined in claim 42 wherein said step of supporting the wireline further comprises the steps of:

inserting a first cylindrical portion of the stop means within a corresponding cylindrical axial passage through the landing sub; and abutting an enlarged second cylindrical portion of the stop means against a corresponding seat within said landing sub.

45. A method for minimizing the tendencey to kink a wireline in a directional drilling system as defined in claim 44 and further comprising the step of:

bypassing drilling fluid around the enlarged second cylindrical portion of the stop means and around the landing sub seat and through the downhole motor and bit simultaneously while supporting the wireline from the stop means within the landing sub.

* * * * *